United States Patent [19]

Buchholz et al.

[11] Patent Number: 4,785,953

[45] Date of Patent: Nov. 22, 1988

[54] REAGENT CONTAINER

[75] Inventors: John F. Buchholz, Boston; Robert S. Potts, Sherborn; Henry J. Rahn, Sharon, all of Mass.

[73] Assignee: Ciba Corning Diagnostics Corp., Medfield, Mass.

[21] Appl. No.: 531,159

[22] Filed: Sep. 9, 1983

[51] Int. Cl.[4] ..... B01L 3/00

[52] U.S. Cl. ..... 215/365; 206/526; 220/23.4

[58] Field of Search ..... 215/1 C, 1 R, 365; 220/20, 23.4, 23.83; 206/569, 486, 562, 563, 526; D7/81; D9/408, 409

[56] References Cited

U.S. PATENT DOCUMENTS

| | | | |
|---|---|---|---|
| 1,759,390 | 5/1930 | Brandt | 206/526 X |
| 2,135,239 | 11/1938 | Patterson | 215/1 R |
| 2,764,309 | 9/1956 | Zelonka | 220/23.4 |
| 3,212,661 | 10/1965 | Adell | 220/18 X |
| 3,743,088 | 7/1973 | Henkin | 206/569 |

FOREIGN PATENT DOCUMENTS

| | | | |
|---|---|---|---|
| 0079152 | 2/1918 | Switzerland | D7/81 |

*Primary Examiner*—Steven M. Pollard

*Attorney, Agent, or Firm*—Daniel Reitenbach

[57] ABSTRACT

Apparatus and a method for orienting a reagent container in a rack so that the label on the container always points towards the user is provided. The container has an external surface at least a portion of which has an asymmetric perimeter which has mirror symmetry about at most one axis, said perimeter lying in a plane substantially parallel to the base of the container. The rack has an aperture having essentially the same asymmetric perimeter as the container and a size which permits the container to be received in the aperture in only one orientation. In certain preferred embodiments, the asymmetric perimeter is D-shaped, the container has a cavity with inwardly sloping sides and the container includes an integral sight glass by which its contents can be viewed.

14 Claims, 2 Drawing Sheets

REAGENT CONTAINER

BACKGROUND OF THE INVENTION

1. Field of the Invention

This invention relates to containers and in particular to containers for carrying and dispensing biological and pharmaceutical reagents and the like. The containers are especially useful in connection with performing in vitro diagnostic analyses.

2. Description of the Prior Art

Numerous containers are known in the art for holding and dispensing reagents. Notwithstanding the wide variety of configurations known, the presently available containers still exhibit numerous deficiencies. One problem area involves applying and reading labels on the containers. For example, when small amounts of reagent have been supplied in the past, small reagent containers have typically been used. These containers have small external surface areas and thus very little room has been available for proper labeling of the container. For both large and small containers, there has been a long standing problem regarding orienting one or a group of containers in such a way that their labels always face the user so that the user can readily read the label and thus select the appropriate reagent.

In addition to labeling problems, the prior art containers have been especially deficient with regard to the dispensing of small amounts of reagent. As mentioned above, small reagent volumes have typically meant small reagent bottles. Such bottles are difficult to handle and manipulate. In particular, it is difficult to pipette reagents, in many cases, radioactive reagents, from such small containers. Also, irrespective of the initial amount of reagent included in the container or the size of the container, in all cases it has been difficult to remove the last portion of the reagent from the bottom of the container by, for example, pipetting.

SUMMARY OF THE INVENTION

In view of the above state of the art regarding containers for biological and pharmaceutical reagents and the like, it is an object of the present invention to provide improved containers for such reagents.

More particularly, it is an object of this invention to provide a method and apparatus for holding a container in a pre-determined orientation, so that, for example, a label on the container will point toward the user.

It is an additional object of the invention to provide containers specifically suited to holding and dispensing small quantities of biological and pharmaceutical reagents and the like, including providing a relatively large external surface for labeling such containers.

It is a further object of the invention to provide a reagent container which is easily manipulated by the user.

It is another object of the invention to provide a reagent container whose contents can be removed by pipetting even when only a small portion of the contents remains in the container.

It is another object of the invention to provide a container having an integral sight glass for visually determining the amount of contents remaining in the container.

To achieve these and other objects, the invention, in accordance with one of its aspects, provides a method for holding a container in a pre-determined orientation comprising the steps of: (a) providing a container which includes a body having an external surface a portion of which has an asymmetric perimeter which has mirror symmetry about at most one axis, said perimeter lying in a plane substantially parallel to the base of the container; and (b) providing means for holding the container which includes an aperture for receiving the container, said aperture having (1) a perimeter of essentially the same shape as the perimeter of the asymmetric portion of the external surface of the container, and (2) a size such that the container cannot be rotated through more than about 90° when the asymmetric portion of the external surface of the container is received in the aperture.

In accordance with another aspect, the invention provides a container which comprises a body having an internal surface and an external surface, said surfaces being joined at a rim which forms the opening of the container, a portion of the internal surface defining a cavity for holding the contents of the container and a portion of the external surface having an asymmetric perimeter which has mirror symmetry about at most one axis, said perimeter lying in a plane substantially parallel to the base of the container.

In accordance with a further aspect, the invention provides a holder for a container which has an external surface which includes a portion having an asymmetric perimeter which has mirror symmetry about at most one axis, said perimeter lying in a plane substantially parallel to the base of the container, comprising a body having an aperture for receiving the container, said aperture having (1) a perimeter of essentially the same shape as the perimeter of the asymmetric portion of the external surface of the container, and (2) a size such that the container cannot be rotated through more than about 90° when the asymmetric portion of the external surface of the container is received in the aperture.

In accordance with certain preferred embodiments of the invention, the asymmetric perimeter is D-shaped, the container's cavity has inwardly sloping sides and the container includes an integral sight glass by which its contents can be viewed.

The accompanying drawings, which are incorporated in and constitute part of the specification, illustrate the preferred embodiments of the invention, and together with the description, serve to explain the principles of the invention. It is to be understood, of course, that both the drawings and the description are explanatory only and are not restricitve of the invention.

DESCRIPTION OF THE PREFERRED EMBODIMENTS

Figure 1:
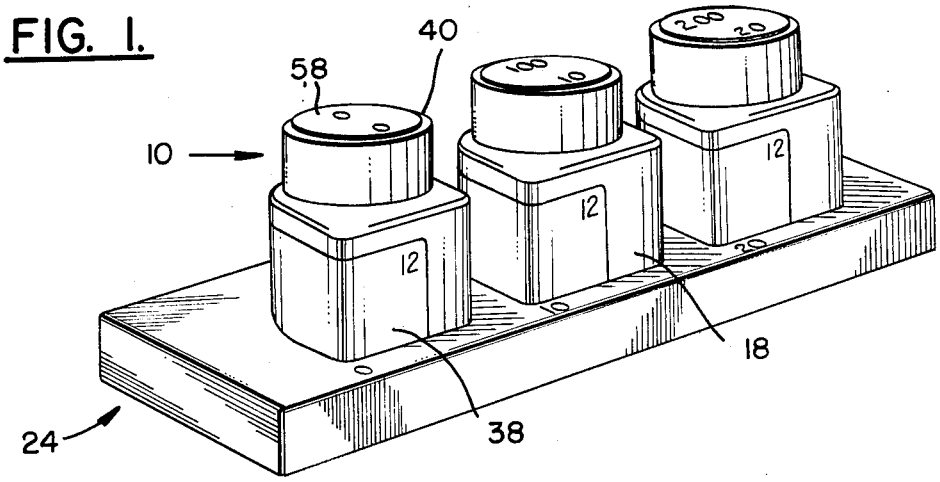
FIG. 1 is a perspective view showing a rack and three containers constructed in accordance with the present invention.
Figure 2:
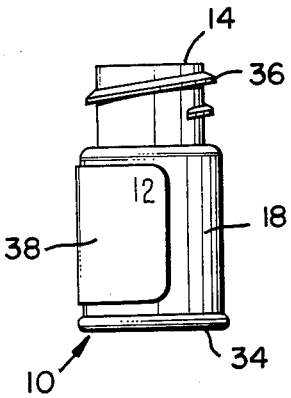
FIG. 2 is a front view of one of the containers shown in FIG. 1.
Figure 3:
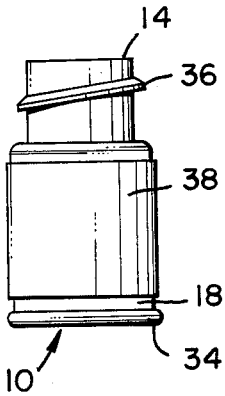
FIG. 3 is a back view of one of the containers shown in FIG. 1.
Figure 4:
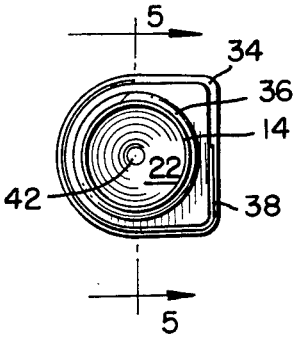
FIG. 4 is a top view of one of the containers shown in FIG. 1.

With reference now to the drawings, wherein like reference characters designate like or corresponding parts throughout the several views, there is shown in FIGS. 1-5 a container 10 having a D-shaped outer perimeter. As shown most clearly in FIG. 1, a plurality of containers 10 is held in rack or holder 24 so that the flat side of the D faces the user. In this way, the portion of label 38 associated with the flat side of the D always faces the user when the container is in the rack. Also, for cap 40 fully screwed onto container 10, the printing on label 58 attached to the cap will similarly always face the user. Accordingly, either or both of these labels can be used to provide critical information regarding the contents of the container so that the user can quickly and accurately select the reagent container he wants.

Reagent container 10 includes body 12 having external surface 18 and internal surface 16, which surfaces are joined at rim 14 to form opening 20 for receiving the contents of the container. A portion of internal surface 16 defines cavity 22 for holding the contents of the container. At least a portion of surface 18 has an asymmetric perimeter in a plane substantially parallel to the base of the container, e.g., is D-shaped in transverse cross-section. Preferably, external surface 18 includes rib 34 extending around the base of the container. This rib tends to stiffen the overall structure of the container and, as described below, is used to retain the container in rack 24.

Although body 12 of container 10 can be made solid, it preferably includes internal wall 28 and external wall 30, which are spaced from each other. Internal wall 28 forms cavity 22, and external wall 30 has a D-shaped perimeter. Constructing body 12 out of an internal and an external wall, rather than making it solid, reduces the amount of material required to form container 10 and thus reduces the cost of the container.

By means of internal wall 28 and external wall 30, a series of containers 10 can be conveniently constructed having internal walls of various sizes and shapes to produce cavities 22 of various sizes and shapes, but having external walls all of the same size and shape. This is one of the ways in which the present invention provides containers especially suited for holding and dispensing small reagent volumes. Specifically, in accordance with the invention, external wall 30 is held at a size convenient for manipulation by the user, while internal wall 28 is reduced in size to a size appropriate for holding a small reagent volume. Also, in this way, containers for small reagent volumes are provided which have a relatively large external surface for labeling purposes, much larger than what would be the case if the external wall was essentially the same size as the internal wall. It should be noted that although it is most convenient to prepare the series of containers having cavities of different sizes using the two wall construction, the same result can be achieved with a solid body 12, at the expense of additional material.

Figure 5:
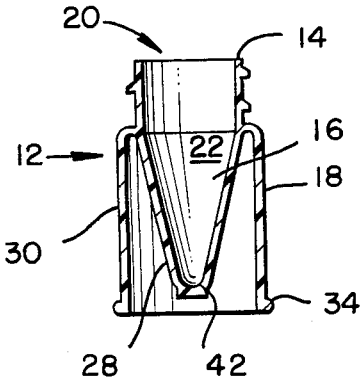
FIG. 5 is a cross-sectional view of one of the containers shown in FIG. 1 along lines 5—5 in FIG. 4.
Figure 6:
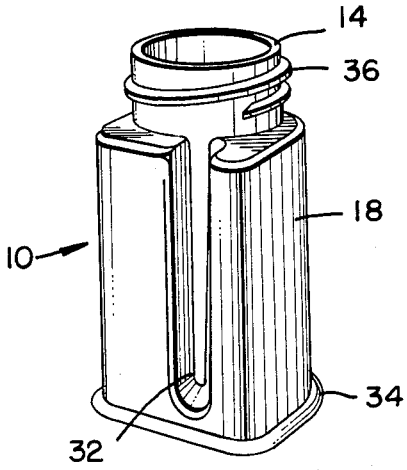
FIG. 6 is a perspective view of a container constructed in accordance with the present invention and including an integral sight glass.
Figure 7:
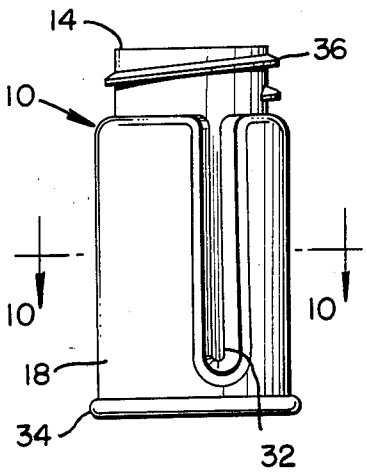
FIG. 7 is a front view of the container shown in FIG. 6.
Figure 8:
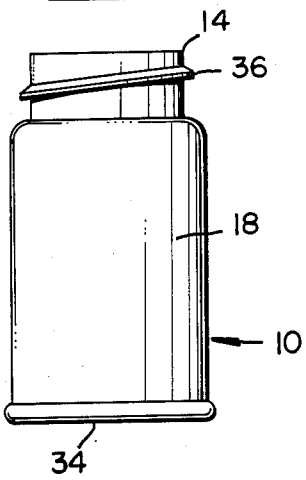
FIG. 8 is a back view of the container shown in FIG. 6.
Figure 9:
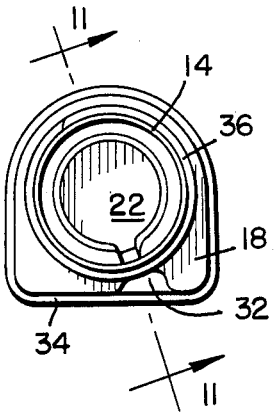
FIG. 9 is a top view of the container shown in FIG. 6.
Figure 10:
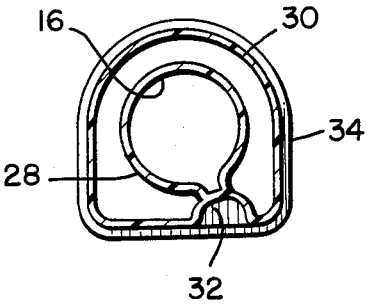
FIG. 10 is a cross-sectional view of the container shown in FIG. 6 along lines 10—10 in FIG. 7.
Figure 11:
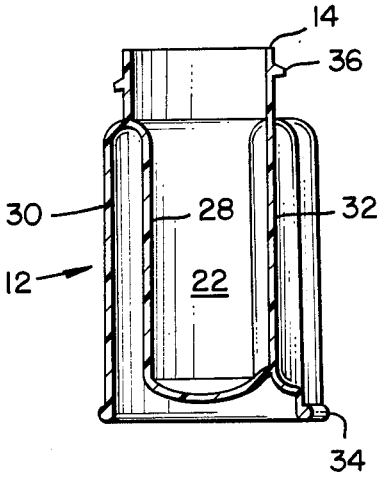
FIG. 11 is a cross-sectional view of the container shown in FIG. 6 along lines 11—11 in FIG. 9.

As shown most clearly in FIG. 5, cavity 22 preferably has sides which slope inwardly as one proceeds from opening 20 to the bottom 42 of the cavity. Having the sides of cavity 22 slope inwardly both makes the container especially suitable for holding small amounts of reagent and, irrespective of the amount of reagent, allows the last portion of the reagent to be conveniently removed from the container by, for example, pipetting. The sloping sides guide the tip of the pipette to the region still containing reagent, as well as increasing the height of the reagent so that the tip of the pipette remains submerged in reagent even for very small remaining volumes of reagent.

FIGS. 6-11 show an additional embodiment of the invention wherein the spacing between internal wall 28 and external wall 30 is reduced to form sight glass 32 whereby the contents of the container can be readily viewed from the outside of the container. As shown most clearly in FIG. 10, in an especially preferred embodiment of the invention, external wall 30 and internal wall 28 are joined together at the location of sight glass 32 to provide essentially a single layer of material between the outside and inside of the container so as to further increase the visability of the contents to the user.

Containers 10 can be closed by various means. The figures illustrate the use of a screw cap 40 which engages a screw thread 36 formed in the neck portion of external surface 18. If desired, screw cap 40 can include an integral pump mechanism (not shown) or other device to aid in dispensing the contents of the container.

Container 10 can be formed out of a variety of materials, including polypropylene, polyethylene and polyethylene terephthalate. A particularly preferred material for container 10 is polypropylene.

Figure 13:
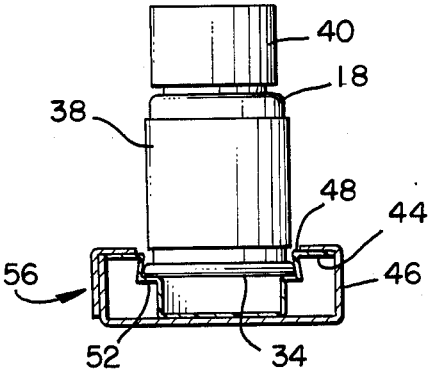
FIG. 13 is a cross-sectional view of the rack of FIG. 1 taken along lines 13—13 of FIG. 12. A side view of the container is included in FIG. 13 to show how the container is received in the rack's aperture.
Figure 12:
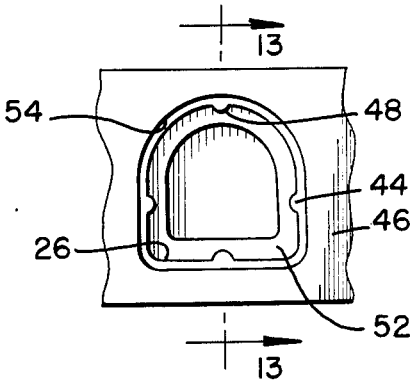
FIG. 12 is a top view of a portion of the rack of FIG. 1 showing the aperture formed in the rack for receiving the container.

Turning now to the construction of rack 24, as shown most clearly in FIGS. 12-13, the rack includes body 56 comprising frame 46 into which has been slid liner 44. Frame 46 is preferably made out of cardboard or a similar material and liner 46 is preferably made out of a yieldable plastic material, such as polystyrene.

Frame 46 has a series of apertures 54 formed therein, one aperture for each container to be held in the rack. Liner 44 has a similar set of apertures 26, the apertures in the frame and the liner being in alignment when the frame and the liner have been united to form rack 24. The apertures in both the frame and the liner have the same D-shape as the perimeter of the asymmetric portion of external surface 18 of container 10. Moreover, these apertures are sized such that the container cannot be rotated through more than about 90° when the asymmetric portion of the external surface of the container is received in the aperture. In one of its preferred embodiments, as described below, container 10 is in fact not free to rotate at all within aperture 26 in liner 44 because of the yieldable engagement of inwardly-directed protuberances 48 formed in the walls of aperture 26 against outwardly extending rib 34 formed in the external surface 18 of container 10.

Containers 10 are inserted in holder 24 by aligning the asymmetric perimeter of the external surface 18 of container 10 with the similar perimeters of apertures 54 and 26 formed in frame 46 and liner 44, respectively. That is, the flat side of the D-shaped outer surface of the container is aligned with the flat sides of the apertures. The container is then passed through aperture 54 in frame 46 and is received by aperture 26 in liner 44. Protuberances 48 slant slightly outwardly as shown most clearly in FIG. 13. Rib 34 engages these protuberances and causes them to yield outwardly so that the bottom of the rib can be moved downwardly until it engages shoulder portion 52 of liner 44. During this process, protuberances 48 snap back over rib 34 to firmly retain container 10 in rack 24.

Although rack 24 has been shown as formed from two parts, i.e., frame 46 and liner 44, it is to be understood that racks having a variety of other configurations can be used with the present invention, provided they have apertures of the appropriate configuration. In the same vein, engagement of protuberances on the rack with a rib on the container is obviously not required to practice the present invention.

Most preferably, the external surface 18 of container 10 has a D-shaped perimeter as shown in the various figures. This provides a container which is conveniently held by the user with his thumb along the flat side of the D and with his fingers rapped around the curved side of the D. This makes the container extremely easy to handle in such procedures as pipetting.

It is to be understood, however, that the external surface 18 of container 10 can have other configurations besides a D shape. In general, so that the container will go into the rack in only one orientation, both the container and the apertures in the rack should have a perimeter which has mirror symmetry about at most one axis. A D-shaped perimeter satisfies this requirement, in that, it has one axis of mirror symmetry, the axis passing through the midpoint of the flat side of the D, but no other axes of mirror symmetry. A rectangle, on the other hand, has two axes of mirror symmetry (one passing through the midpoints of the long sides of the rectangle and one passing through the midpoints of the short sides of the rectangle), and thus does not satisfy the mirror symmetry requirement and cannot provide the orientation aspects of the present invention. A circle and an equilateral triangle similarly do not satisfy the one axis of mirror symmetry requirement. An isosceles triangle, a trapezoid and a completely asymmetric perimeter, in contrast, do satisfy the requirement. However, the D-shape illustrated herein is preferred over these other shapes because the D-shape is more pleasing to hold and has a natural orientation in the user's hand, as described above.

With the above and other modifications and variations in mind, it is to be understood that within the scope of the appended claims, the invention may be practiced otherwise than as specifically described.

What is claimed is:

1. A method for holding a container in a single predetermined orientation comprising the steps of:

providing a container which includes a body having an external surface a portion of which has an asymmetric perimeter which has mirror symmetry about at most one axis, said perimeter lying in a plane substantially parallel to the base of the container; and providing means for holding the container which includes an aperture for receiving the container, said aperture having (1) a perimeter of essentially the same shape as the perimeter of the asymmetric portion of the external surface of the container, and (2) a size such that the container is received in the aperture and releaseably secured thereby such that the asymmetric portion of the container is adjacent to the asymmetric portion of the holding means aperture.

2. The method of claim 1 wherein the asymmetric portion of the external surface of the container and the aperture have corresponding labels and are D-shaped.

3. The method of claim 1 wherein the container is provided with a cavity for holding the contents of the container, the sides of the cavity sloping inwardly down to the bottom of the cavity.

4. The method of claim 1 wherein the container's body includes an internal wall which forms a cavity for holding the contents of the container and an external wall at least a portion of which has the asymmetric perimeter having mirror symmetry about at most one axis.

5. The method of claim 4 wherein (1) the holding means is provided with a plurality of apertures all of the same size and shape, and (2) a plurality of containers is provided all having external walls of the same size and shape with at least one of the containers having an internal wall which defines a smaller cavity than the cavity of at least one of the other containers.

6. The method of claim 4 wherein the spacing between the internal and external walls of the container is reduced shape at one or more locations to permit viewing of the contents of the container.

7. The method of claim 6 wherein the internal and external walls are joined at the one or more locations.

8. A container which comprises a body having an internal surface and an external surface, said surfaces being joined at a rim which forms the opening of the container, a portion of the internal surface defining a cavity for holding the contents of the container and a portion of the external surface having an asymmetric perimeter which has mirror symmetry about at most one axis, said perimeter lying in a plane substantially parallel to the base of the container, wherein the cavity has sides which slope inwardly down to the bottom of the cavity.

9. A series of containers wherein each container comprises a body having an internal surface and an eternal surface, said surfaces being joined at a rim which forms the opening of the container, a portion of the internal surface defining a cavity for holding the contents of the container and a portion of the external surface having an asymmetric perimeter which has mirror symmetry about at most one axis, said perimeter lying in a plane substantially parallel to the base of the container, wherein the body of each container includes an internal wall which forms the cavity and an external wall having the asymmetric perimeter, and wherein all the containers have external walls of the same size and shape and at least one of the containers has an internal wall which defines a smaller cavity than the cavity of at least one of the other containers.

10. A container which comprises a body having an internal surface joined at a rim which forms the opening of the container, a portion of the internal surface defining a cavity for holding the contents of the container and a portion of the external surface having an asymmetric perimeter which has mirror symmetry about at most one axis, said perimeter lying in a plane substantially parallel to the base of the container, wherein the body includes an internal wall which forms the cavity and an external wall having the asymmetric perimeter, and wherein the spacing between the internal and external walls of the container is reduced at one or more locations to permit viewing of the contents of the container.

11. The container of claim 10 wherein the internal and external walls are joined at the one or more locations.

12. A holder for a container which has an external surface which includes a portion having an asymmetric perimeter which has mirror symmetry about at most one axis, said perimeter lying in a plane substantially parallel to the base of the container, comprising a body having an aperture for receiving the container, said aperture having (1) a perimeter of essentially the same shape as the perimeter of the asymmetric portion of the external surface of the container, and (2) a size such that the container is received in the aperture and releaseably secured thereby such that the asymmetric portion of the container is adjacent to the asymmetric portion of the holder aperture.

13. The holder of claim 12 wherein the aperture is D-shaped.

14. The holder of claim 12 wherein the body includes a plurality of apertures all of the same size and shape.

* * * * *